US006877190B2

(12) United States Patent
Berger

(10) Patent No.: US 6,877,190 B2
(45) Date of Patent: Apr. 12, 2005

(54) STRAP FASTENER

(76) Inventor: Jan Gisle Berger, Josefinesgt, 28a, N-0351 Oslo (NO)

( * ) Notice: Subject to any disclaimer, the term of this patent is extended or adjusted under 35 U.S.C. 154(b) by 0 days.

(21) Appl. No.: 10/221,972

(22) PCT Filed: Mar. 9, 2001

(86) PCT No.: PCT/NO01/00106

§ 371 (c)(1),
(2), (4) Date: Nov. 21, 2002

(87) PCT Pub. No.: WO01/67909

PCT Pub. Date: Sep. 20, 2001

(65) Prior Publication Data

US 2003/0221295 A1 Dec. 4, 2003

(30) Foreign Application Priority Data

Mar. 17, 2000 (NO) ..... 20001430
Sep. 12, 2000 (NO) ..... 20004552

(51) Int. Cl.[7] ..... A44B 11/06; A44B 11/10; A44B 21/00

(52) U.S. Cl. ..... 24/196; 24/68 CD; 24/122.6; 24/197; 24/418; 606/234

(58) Field of Search ..... 24/196, 197, 122.6, 24/115 L; 606/234; 2/6.5, 418, 421

(56) References Cited

U.S. PATENT DOCUMENTS 2,926,406 A * 3/1960 Edwards et al. ..... 2/418
3,226,791 A * 1/1966 Carter ..... 24/196
3,293,713 A * 12/1966 Gaylord ..... 24/196
4,184,234 A * 1/1980 Anthony et al. ..... 24/196
4,336,636 A * 6/1982 Ishiguro et al. ..... 24/196
4,473,926 A * 10/1984 Ono ..... 24/196
4,606,348 A * 8/1986 Panicci ..... 606/234
4,823,443 A * 4/1989 Waters ..... 24/68 CD
5,027,479 A * 7/1991 Scheffczyk ..... 24/196
5,173,996 A * 12/1992 Chou ..... 24/68 CD

FOREIGN PATENT DOCUMENTS

DE 3629287 * 8/1986

* cited by examiner

*Primary Examiner*—Victor Sakran
(74) *Attorney, Agent, or Firm*—Wolf Greenfield & Sacks PC

(57) ABSTRACT

A strap fastener intended for locking at least one strap tightenably arranged in the strap fastener. The locking of the strap or each of the straps is effected by means of a leaf spring (1) and a roller (2, 3) rotatably arranged in some distance from an end edge (4, 5) of the leaf spring (1). The distance is adapted in such a manner that the strap or each of the straps during the locking may be clamped between the respective roller (2, 3) and edge (4, 5).

16 Claims, 3 Drawing Sheets

STRAP FASTENER

RELATED APPLICATIONS

This application claims the benefit under 35 U.S.C. §120 or 35 U.S.C. §365(c) of PCT International application PCT/NO01/00106 designating the United States of America, and filed Mar. 9, 2001, of which this application is a national stage filing under 35 U.S.C. §371, was published under PCT Article 21(2) in English.

Foreign priority benefits are claimed under 35 U.S.C. §119(a)–(d) or 35 U.S.C. §365(b) of Norway Application Nos. 2000 1430 and 2000 4552, which designated at least one country other than the United States.

BACKGROUND OF THE INVENTION

The invention relates to a strap fastener intended for locking at least one strap tightenably arranged in the strap fastener.

There are several different strap fasteners of the type mentioned above. Examples of such strap fasteners are disclosed in DE-C1 3629287 and U.S. Pat. No. 5,027,479. However, an essential disadvantage of the known strap fasteners is that these are not able to be used for the tightening and locking of two separate straps but are supposed to be used together with a single strap. An additional disadvantage is that the mechanism enabling the tightening, locking and subsequent withdrawal of the strap does not have any protection against external influence which may damage this mechanism.

SUMMARY OF THE INVENTION

The disadvantages mentioned above regarding the known strap fasteners are remedied by the present invention wherein, according to the present independent patent claim 1, the locking of the strap or each of the straps is effected by means of a leaf spring and a roller rotatably arranged in some distance from a transverse end edge of the leaf spring, wherein the distance is adapted in such a manner that the strap or each of the straps during the locking may be clamped between the respective rollers and end edges. Other advantageous features according to the present invention will be apparent from the dependent patent claims and the remainder of the description. Thereby, it is provided a strap fastener which may be used for separate straps, which is easy to operate during the tightening, locking and subsequent releasing of the strap or straps for withdrawal, and which by means of an outer cap may protect the mechanism enabling such a tightening, locking and releasing.

In the following part of the description a preferred embodiment of the invention shall be explained, with reference to the accompanying drawings.

DESCRIPTION OF AN EMBODIMENT

Figure 1:
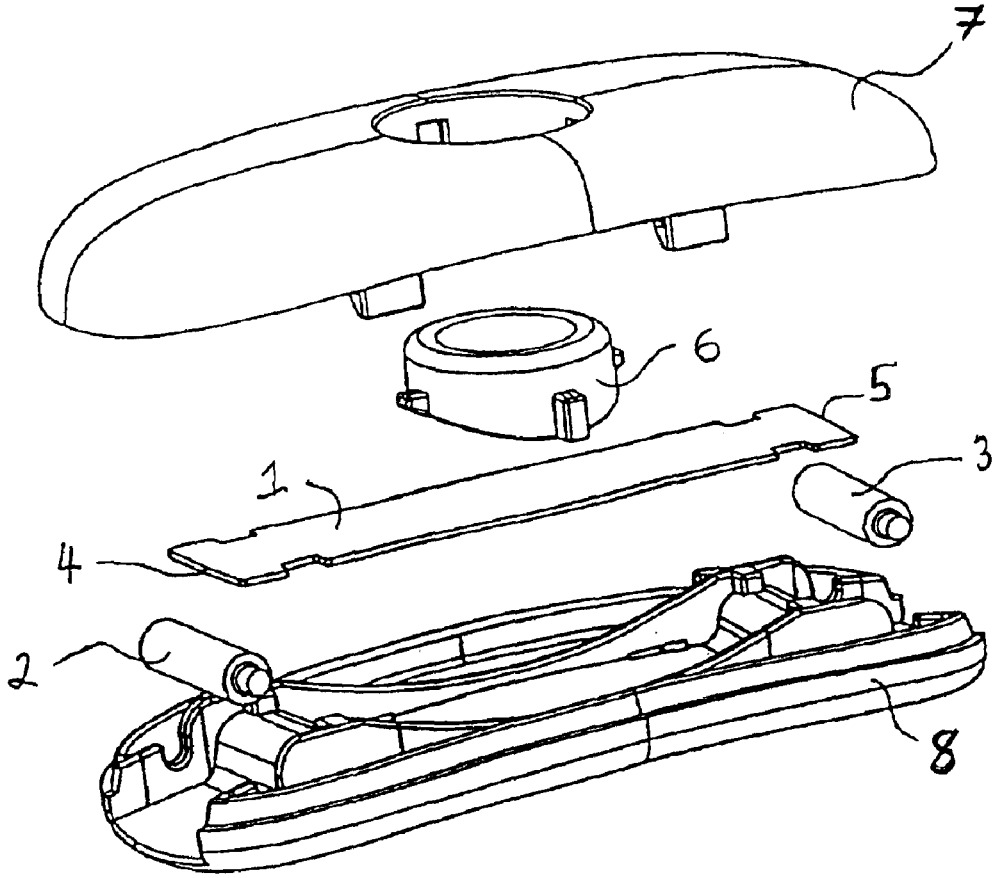
FIG. 1 shows schematically a perspective view of a strap fastener according to the present invention, having the components separated, which in the illustrated embodiment comprises an outer dividable cap, a leaf spring and two rollers, which all together enable the tightening, locking and subsequent releasing of two straps (not shown) inserted between a respective roller and end edge of the leaf spring, and a release button which may release the locking by being pressed against a central portion of the leaf spring.
Figure 2:
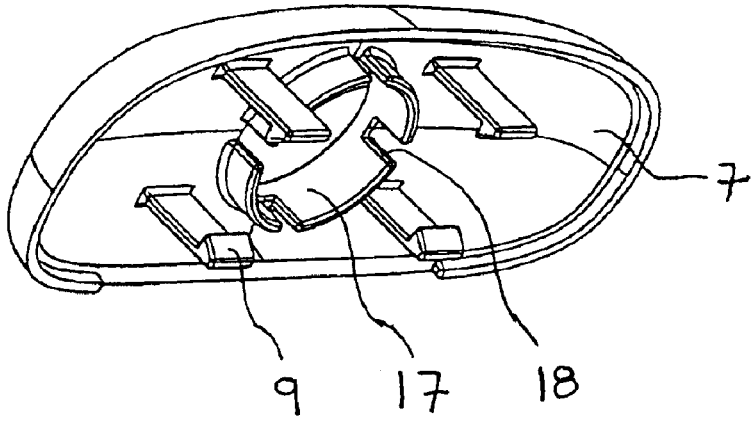
FIGS. 2–6 show schematical perspective views, partly illustrated in different scales, of the strap fastener components.
Figure 3:
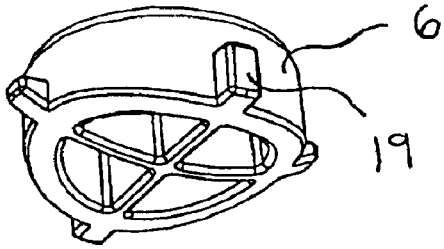
Figure 4:
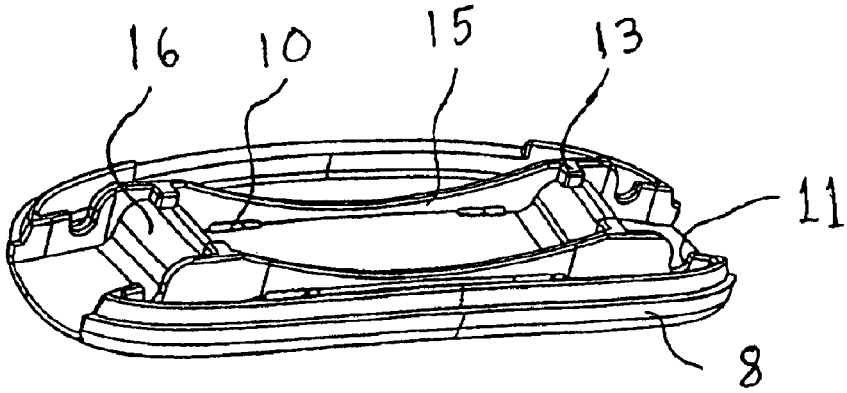
Figure 5:
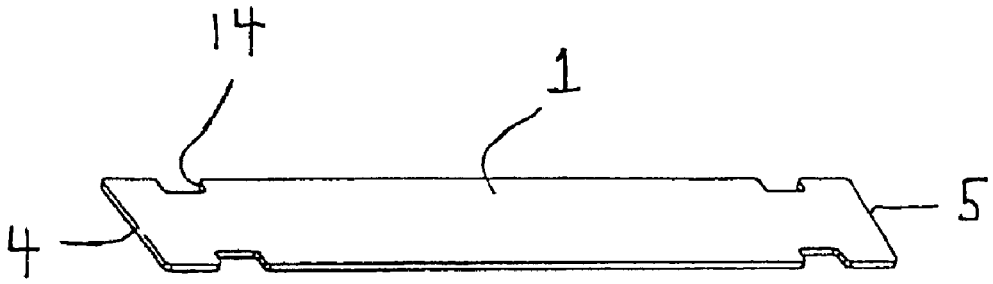

The strap fastener according to the present invention comprises an outer cap. The cap is dividable and consists of two cap parts 7, 8 which may be connected by means of a snap connection 9, 10 or the like. For instance, as shown in FIGS. 2 and 4, the snap connection has four arms 9, each provided with a lower bulging. The arms 9 protrude from one of the cap parts 7 and are intended to be inserted into apertures 10 in the other cap part 8. The apertures 10 are located in connection with and partly below two longitudinal ribs 15 or the like on the cap part 8, whereby the arm portion above the bulging may advantageously be supported against the side portion of the rib 15.

The strap fastener is normally used together with two separate straps (not shown). The straps are tightenably arranged and led through a respective slit in the cap of the strap fastener. The slits for the straps are situated adjacent two rollers 2, 3 rotatably journalled at the end edges 4. 5 of a leaf spring 1. The journalling of the rollers 2, 3 in the cap part 8 is accomplished by means of narrowed end portions or pins 12 provided at the roller ends and located in recesses 11 at the upper side of the ribs 15. The leaf spring 1 is positioned in the cap part 8 by means of cams 13 and recesses 14. The recesses 14 are provided along the longitudinal edge of the leaf spring 1 and adapted to surround the cams 13. The cams 13 are situated at the inner side of the longitudinal ribs 15 and at the upper side of two transverse ribs 16.

The disposal of the straps in the strap fastener is done before the cap parts 7, 8 are connected. The strap fastener mounting is accomplished in a manner involving that one of the straps is firstly placed above the cap part 8 with an appropriate length past the transverse rib 16, then the roller 2 is placed in the cap part 8 by pushing its pins downwardly into their recesses 11 in the longitudinal ribs 15 and finally the strap is drawn rearwardly until it is situated nearby the roller 2. This is repeated for the second strap before the leaf spring 1 is placed in the cap part 8 by pushing its recesses 14 downwardly onto the cams 15 at the top of the transverse ribs 16. Before the mounting is finished by securing the cap parts 7, 8 to one another by means of the snap connection 9, 10, a release button 6 is placed in a separate sleeve-shaped aperture 17 in the cap part 7. The release button 6 has guiding protrusions 19 intended to run in recesses at a lower end of the aperture 17. As will be appreciated the cap 7, 8 of the strap fastener may possibly be opened by means of the snap connection 9, 10, e.g. for the replacement of a damaged strap or the insertion of a strap having been withdrawn from the strap fastener.

It will be appreciated that the present strap fastener also is applicable in connection with only one single tightenable strap led into and out from one of the ends of the strap fastener. One example of a modification for such an application is the replacement of the strap at one of the end edges 5 of the leaf spring 1 by a strap loop which may readily be threaded onto the roller 3 at this end edge 5. Another example is that one of the tightenable straps is replaced by a hoop-like member of an appropriate material. One of the ends of this hoop member may either be rigidly or rotatably attached to one of the rollers 2, 3. Particularly in the latter instance the end of the hoop-like member, at the outer side of the strap fastener, will be able to be rigidly or releasably attached to another article directly or via an appropriate extension.

During the tightening of the strap or straps, i.e. when the user pulls the strap portion or portions projecting from the strap fastener, the parts of the strap or straps now situated in a respective slit between the rollers 2, 3 and two end edges 4, 5 of the leaf spring 1, displace the end edges somewhat outwardly from the rollers 2, 3. This involves that the distance between each roller 2, 3 and end edge increases, whereby the straps may pass unobstructed through the slits.

After the straps have been tightened into the desired position in the strap fastener, the straps are prevented from unwanted withdrawal by being clamped in the slits, i.e. the straps are clamped by means of the rollers 2, 3 and end edges 4, 5. The clamping is effected in a manner involving, immediately after the tightening and due to this, that the straps will be withdrawn somewhat in the strap fastener. Thereby, the straps will move the leaf spring from the curved position into a substantial planar or flattened position for the locking of the straps. This means that the rollers 2, 3 must be located in such a distance from the end edges 4, 5 of the leaf spring 1 that, when the leaf spring 1 is situated in the substantially planar position for locking the straps, the slit between these is sufficiently small to ensure the clamping of the straps in the slits.

The locking may be released by means of the release button 6 situated in the cap part 7 above the straps and preferably located at a central portion of the leaf spring 1. Thus, pressing of the release button 6 will have the effect that the leaf spring 1 regains the same curved configuration as during the tightening, having the end edges 4, 5 outwardly displaced from the rollers 2, 3. This involves that the straps again have a free passage in the slits between the rollers 2, 3 and the end edges 4, 5, whereby the straps may be withdrawn to an untightened position in the strap fastener.

Figure 6:
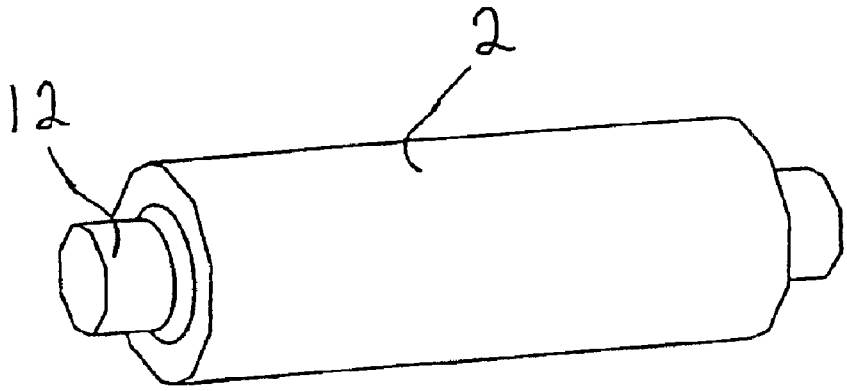

It is considered as being advantageously if at least one of the rollers 2, 3 and end edges 3, 4 are inclined relatively to the longitudinal axis of the leaf spring 1, e.g. having an angle of about 100. This will partly increase the contact area for the clamping of the straps during the locking and partly provide a better fitting of the straps against their abutting surfaces during the use of the strap fastener. Moreover, it is advantageous if the peripheral surface of each of the rollers 2, 3 and/or their narrowed end portions or pins are provided with several planar portions, as illustrated in FIG. 6, as this particularly contributes to a more secure locking of the straps.

The present strap fastener is specially intended for helmet straps, but the strap fastener may of course be used within other fields of application. One of several examples of such an alternative application is rucksack straps, e.g. such being used for the securing of sleeping bags, the tightening of the sack opening, etc. The straps used in connection with the illustrated embodiment are flat, but the rollers 2, 3 and end edges 4, 5 may of course be modified in order to be suited for straps having curved surfaces.

What is claimed is:

1. A strap fastener for locking at least one strap, the strap fastener comprising:

a leaf spring; and a pair of rollers, one each of the rollers rotatably arranged a distance from a corresponding end edge of one of a pair of end edges of the leaf spring, wherein the distance is sized such that when the at least one strap is locked in the fastener, the at least one strap is clamped between the roller and the end edge.

2. A strap fastener according to claim 1, wherein at least one of the pair of rollers and the corresponding end edge of the leaf spring are inclined relative to a longitudinal axis of the leaf spring.

3. A strap fastener according to claim 1, wherein the leaf spring and the pair of rollers are located in a dividable cap.

4. A strap fastener according to claim 3, wherein the dividable cap comprises parts connected by a snap connection.

5. A strap fastener for locking at least one strap, the strap fastener comprising:

a leaf spring; and a roller rotatably arranged a distance from a corresponding end edge of the leaf spring, wherein the distance is sized such that when the at least one strap is locked in the fastener, the at least one strap is clamped between the roller and the end edge;

further wherein the tightening of the at least one strap causes the end edge of the leaf spring to displace away from the roller, allowing the at least one strap to pass freely between the roller and the end edge.

6. A strap fastener according to claim 5, wherein the roller and the corresponding end edge of the leaf spring are inclined relative to a longitudinal axis of the leaf spring.

7. A strap fastener according to claim 5, wherein the leaf spring and roller are located in a dividable cap.

8. A strap fastener according to claim 7, wherein the dividable cap comprises parts connected by a snap connection.

9. A strap fastener according to claim 5, wherein the roller comprises a pair of rollers and the end edge comprises a pair of end edges, one each of the rollers rotatably arranged the distance from a corresponding one of the pair of edges of the leaf spring.

10. A strap fastener according to claim 5, wherein the roller comprises a single roller and the corresponding end edge comprises a single end edge.

11. A strap fastener for locking at least one strap, the strap fastener comprising:

a leaf spring;

a roller rotatably arranged a distance from a corresponding end edge of the leaf spring, wherein the distance is sized such that when the at least one strap is locked in the fastener, the at least one strap is clamped between the roller and the end edge; and a release button arranged adjacent a portion of the leaf spring away from the end edge, whereby pressing the release button against the leaf spring causes the end edge to displace away from the roller, allowing the at least one strap to pass freely between the roller and the end edge.

12. A strap fastener according to claim 11, wherein the roller and the corresponding end edge of the leaf spring are inclined relative to a longitudinal axis of the leaf spring.

13. A strap fastener according to claim 11, wherein the leaf spring, roller and release button are located in a dividable cap.

14. A strap fastener according to claim 13, wherein the dividable cap comprises parts connected by a snap connection.

15. A strap fastener according to claim 11, wherein the roller comprises a pair of rollers and the end edge comprises a pair of end edges, one each of the rollers rotatably arranged the distance from a corresponding one of the pair of edges of the leaf spring.

16. A strap fastener according to claim 11, wherein the roller comprises a single roller and the corresponding end edge comprises a single end edge.

* * * * *